US010537984B2

(12) United States Patent
Steingruber et al.

(10) Patent No.: US 10,537,984 B2
(45) Date of Patent: Jan. 21, 2020

(54) SIDE HANDLE

(71) Applicant: Hilti Aktiengesellschaft, Schaan (LI)

(72) Inventors: Adrian Steingruber, Schwabmuenchen (DE); Oliver Ohlendorf, Landsberg (DE)

(73) Assignee: Hilti Aktiengesellschaft, Schaan (LI)

( * ) Notice: Subject to any disclaimer, the term of this patent is extended or adjusted under 35 U.S.C. 154(b) by 170 days.

(21) Appl. No.: 15/749,735

(22) PCT Filed: Jul. 26, 2016

(86) PCT No.: PCT/EP2016/067764
§ 371 (c)(1),
(2) Date: Feb. 1, 2018

(87) PCT Pub. No.: WO2017/021210
PCT Pub. Date: Feb. 9, 2017

(65) Prior Publication Data

US 2018/0229356 A1 Aug. 16, 2018

(30) Foreign Application Priority Data

Aug. 6, 2015 (EP) ..... 15179926

(51) Int. Cl.
*B25D 17/04* (2006.01)
*B25F 5/02* (2006.01)
*B25F 5/00* (2006.01)

(52) U.S. Cl.
CPC ..... *B25F 5/026* (2013.01); *B25F 5/006* (2013.01); *B25D 17/043* (2013.01)

(58) Field of Classification Search
CPC ..... B25F 5/006; B25F 5/026; B25D 17/043
See application file for complete search history.

(56) References Cited

U.S. PATENT DOCUMENTS 7,137,542 B2 * 11/2006 Oki ..... B25D 17/043 173/162.2
7,451,524 B2 * 11/2008 Sattler ..... B25F 5/006 16/421

(Continued)

FOREIGN PATENT DOCUMENTS

EP 1 514 648 A2 3/2005
EP 1 674 216 B1 6/2006

(Continued)

OTHER PUBLICATIONS

PCT/EP2016/067764, International Search Report (PCT/ISA/220 and PCT/ISA/210) dated Aug. 26, 2016, with partial English translation (Nine (9) pages).

*Primary Examiner* — Andrew M Tecco
(74) *Attorney, Agent, or Firm* — Crowell & Moring LLP

(57) ABSTRACT

A side handle for a hand-operated power tool includes a handle rod disposed along a handle axis and a fastening mechanism, where the side handle is releasably fastenable to the hand-operated power tool by the fastening mechanism. The fastening mechanism includes a tensioning band that engages around a fastening axis and a tensioning mechanism. The tensioning mechanism has a pull rod that is anchored to the tensioning band and is displaceable along the handle axis and a tensioning wheel that is rotatable about the handle axis and engages in an external thread of the pull rod. A damper connects the handle rod to the fastening mechanism and includes a leaf spring with a longitudinal side oriented in an inclined manner to the fastening axis where the leaf spring has a slot. A splint is fastened to the pull rod and engages in the slot.

9 Claims, 2 Drawing Sheets

(56) References Cited

U.S. PATENT DOCUMENTS

| | | | | |
|---|---|---|---|---|
| 8,256,528 | B2 * | 9/2012 | Oesterle | B25F 5/026 173/162.1 |
| 8,914,947 | B2 * | 12/2014 | Weiss | B25D 17/043 16/426 |
| 9,308,638 | B2 * | 4/2016 | Kondo | B25F 5/02 |
| 2005/0087353 | A1 * | 4/2005 | Oki | B25D 17/043 173/162.2 |
| 2006/0130279 | A1 * | 6/2006 | Sattler | B25F 5/006 16/426 |
| 2009/0039576 | A1 * | 2/2009 | Eicher | B25F 5/006 267/137 |
| 2009/0283283 | A1 * | 11/2009 | Oesterle | B25F 5/006 173/162.2 |
| 2014/0020210 | A1 * | 1/2014 | Brennenstuhl | B25F 5/026 16/426 |
| 2014/0196921 | A1 * | 7/2014 | Kondo | B25F 5/02 173/46 |

FOREIGN PATENT DOCUMENTS

| | | |
|---|---|---|
| EP | 2 159 009 A1 | 3/2010 |
| EP | 2 241 408 A1 | 10/2010 |

* cited by examiner

SIDE HANDLE

This application claims the priority of International Application No. PCT/EP2016/067764, filed Jul. 26, 2016, and European Patent Document No. 15179926.9, filed Aug. 6, 2015, the disclosures of which are expressly incorporated by reference herein.

BACKGROUND AND SUMMARY OF THE INVENTION

The present invention relates to a side handle for a hand-operated power tool.

A side handle is known from EP 1674216 B1. The side handle has a handle rod and a fastening mechanism. The handle rod is attached by the fastening mechanism by means of a leaf spring bent into a ring.

The side handle for a hand-operated power tool has a handle rod arranged along a handle axis for holding the side handle with one hand, a fastening mechanism, and a damper. The fastening mechanism for releasably fastening the side handle to the hand-operated power tool has a tensioning band, which engages around the fastening axis, and a tensioning mechanism. The tensioning mechanism has a collar that overlaps with the tensioning band along the handle axis and is displaceable with respect to the tensioning band along the handle axis, a pull rod that is anchored to the tensioning band and is displaceable along the handle axis, and a tensioning wheel that can be rotated about the handle axis and engages in an external thread of the pull rod. The damper connects the handle rod to the fastening mechanism. The damper has at least one longitudinal side, which is oriented at an inclination to the fastening axis, of a leaf spring, wherein the leaf spring has a slot, which extends along the handle axis. A splint is fastened to the pull rod and engages in the slot in the leaf spring. The splint of the pull rod ensures the orientation of the leaf spring in relation to the fastening axis, without influencing the damping behavior or impairing the simple, tool-free fastening to the tensioning wheel.

One design provides that the leaf spring is oriented perpendicular to the fastening axis; the splint can be oriented longitudinally or parallel to the fastening axis.

One design provides that the damper has a safety retainer, which is fastened to the handle rod and in which the leaf spring is arranged, wherein the safety retainer has a slot, into which the splint engages, running along the handle axis. The safety retainer protects the user should the leaf spring break, by the handle rod still being connected via the splint and the pull rod to the fastening mechanism.

In one design, the safety retainer may have an inclined interior surface, a distance from which to the longitudinal side of the leaf spring increases in the direction from the handle rod to the fastening mechanism. In addition or as an alternative, the tensioning wheel may have a border protruding in the direction toward the handle rod, the border overlapping along the handle axis with the safety retainer. The border has a clearance to safety retainer in a radial direction to the handle axis. The designs limit a deflection of the leaf spring to prevent an overload, without influencing the damping behavior of the leaf spring in the event of a slight deflection.

One design provides that the leaf spring has two longitudinal sides parallel to each other, which are connected to each other via transverse sides running perpendicular to the handle axis. Through the form, the leaf spring has an inherently high mechanical stability, particularly in relation to torsion loads.

One design provides that one of the transverse sides of the leaf spring has a hole on the handle axis, and the tensioning wheel abutting the transverse side has a nut, which has a neck guided through the hole and a head back-gripping the hole. The structure allows a fastening of the leaf spring with a small number of components.

The following description explains the invention using illustrative embodiments and drawings.

DETAILED DESCRIPTION OF THE DRAWINGS

Figure 1:
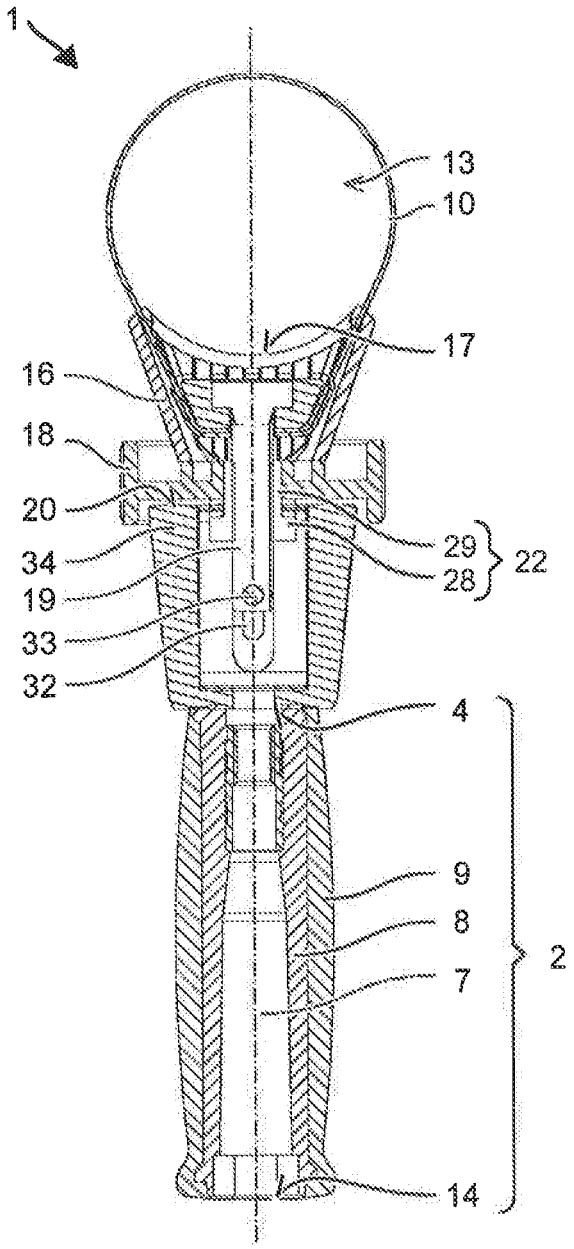
FIG. 1 illustrates a side handle in a longitudinal cross-section.

The same of function-identical elements are indicated using the same reference signs in the drawings, unless specified otherwise.

Figure 2:
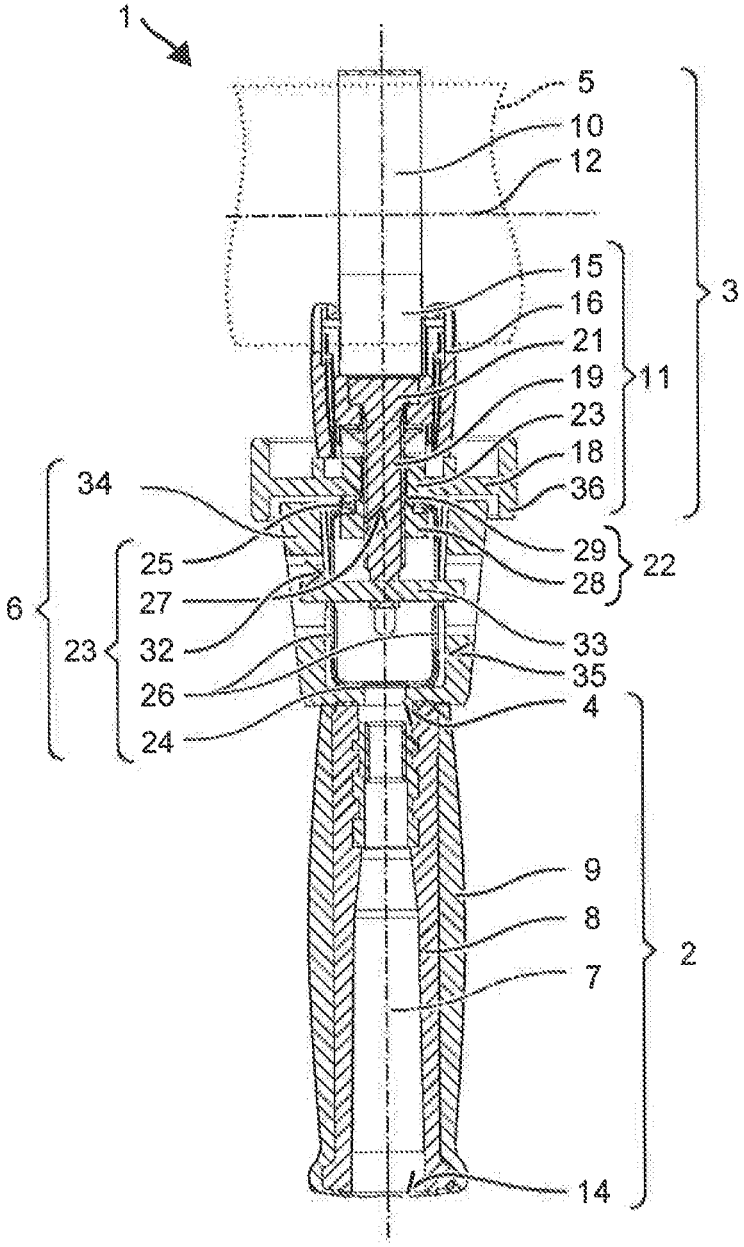
FIG. 2 illustrates the side handle in a longitudinal cross-section perpendicular to FIG. 1.

FIGS. 1 and 2 depict an illustrative side handle 1 in two longitudinal cross-sections. Side handle 1 has a handle rod 2 and a fastening mechanism 3, which on one side is arranged at a proximal end 4 of handle rod 2. Fastening mechanism 3 allows one to fasten side handle 1 to a hand-operated power tool 5 and to release the side handle from the power tool. The user can grip handle rod 2 to hold and guide a hand-operated power tool when operating it. Between handle rod 2 and fastening mechanism 3, there is arranged a damper 6, which decreases a transfer of vibrations of hand-operated power tool 5 to handle rod 2.

Handle rod 2 is an elongated rod, which can be gripped around with one hand by the user. The longitudinal axis of the rod is hereinafter designated handle axis 7. Handle rod 2 may have a handle section, which diameter and length are preferably configured according to ergonomic factors. Illustrative handle rod 2 is rotation-symmetric to handle axis 7. As depicted, handle rod 2 may be designed bulbously or cylindrically or non-symmetrically with a contour for the fingers. Handle rod 2 may have a hollow, cylindrical base body 8 made of a hard plastic. Base body 8 is preferably encapsulated with an outer cover 9 made of a soft foam material or elastomer.

Fastening mechanism 3 has a tensioning band 10 and a tensioning mechanism 11. Tensioning band 10 is preferably a metal band bent into a loop, or alternatively a textile strip. Tensioning band 10 orients side handle 1 on hand-operated power tool 5 along a fastening axis 12. Fastening axis 12 is defined by eye 13 of tensioning band 10. Fastening axis 12 runs perpendicular through the center of eye 13. The user can push tensioning band 10 on to the housing of the hand-operated power tool 5 along the fastening axis 12; typically, side handle 1 is oriented with its fastening axis 12 parallel to a working axis of the hand-operated power tool 5, e.g., by the tensioning band 10 being seated around a cylindrical section near a tool holder. Fastening axis 12 lies in one plane with handle axis 7; fastening axis 12 is preferably perpendicular or inclined at least by more than 60 degrees relative to handle axis 7.

Fastening mechanism 3 lies offset to handle rod 2 on handle axis 7. Proximal end 4, lying on handle axis 7, of handle rod 2 has a distal end pointing to fastening mechanism 3; a distal end 14 faces away from fastening mechanism 3. The terms "proximal" and "distal" are based on the provided arrangement of side handle 1 on hand-operated power tool 5. Proximal end 4 is the end along handle axis 7 closer to hand-operated power tool 5 and to fastening axis 12 respectively, and correspondingly distal end 14 is the end further away. Handle rod 2 and handle axis 7 typically stick out perpendicular from the housing of hand-operated power tool 5.

Illustrative tensioning mechanism 11 separates a section 15 of tensioning band 10 away from the housing, whereby the remaining section is clamped to the housing. Tensioning mechanism 11 has a collar 16, which partially overlaps with eye 13 of tensioning band 10. Tensioning band 10 may be displaced relative to collar 16 along handle axis 7, as the overlap of collar 16 with eye 13 increases. The free opening of eye 13 decreases, by means of which tensioning band 10 is clamped to the housing. Collar 16 has a support surface 17 facing away from handle rod 2, the surface being designed in a circular arc-shape for example. Support surface 17 may be designed in a complementary manner to the contour of the housing of hand-operated power tool 5; however, it may also be designed simply by one or more support struts, which abut the housing only in a point-wise manner. Illustrative collar 16 is saucer-shaped with two parallel circular arc-shaped support braces, between which there is a gap in the width of tensioning band 10. Section 15 of tensioning band 10 runs partially between the support surfaces in the gap.

Tensioning mechanism 11 has a tensioning wheel 18 and a pull rod 19, which displace the section 15, near collar 16, of tensioning band 10 relative to collar 16. Tensioning wheel 18 is rotatably seated on collar 16 around handle axis 7. Tensioning wheel 18 is braced along handle axis 7 at least in the direction toward tensioning band 10, i.e., support surface 17 of collar 16, for example on a side 20, facing handle rod 2, of collar 16. Pull rod 19 is arranged coaxially to handle axis 7 and is movable along it. Pull rod 19 is anchored in section 15 near collar 16. Preferably, pull rod 19 cannot rotate relative to tensioning band 10 about handle axis 7. For example, pull rod 19 is welded on to tensioning band 10. Alternatively, a head 21 of pull rod 19 is caught in a form-fitting manner in collar 16 and is moveable only along handle axis 7. Tensioning band 10 is also not rotatable about handle axis 7 relative to collar 16.

Pull rod 19 has a worm thread or a similar tooth arrangement which engages in a nut 22 of tensioning wheel 18. The user can turn the tensioning wheel 18 by hand and also displace pull rod 19 along handle axis 7. In doing so, section 15 is moved through pull rod 19 in relation to collar 16—if necessary its overlap with collar 16 is increased—to clamp the other section of tensioning band 10 to the housing of hand-operated power tool 5.

Handle rod 2 and fastening mechanism 3 are connected to each other by means of damper 6 positioned between them. Damper 6 allows for a relative deflection of handle rod 2 in relation to fastening mechanism 3 along fastening axis 12; however, damper 6 thereby exerts a force counteracting the deflection. Oriented longitudinally to handle axis 7, damper 6 comprises a leaf spring 23, which distal section is fastened to handle rod 2 and its proximal section is fastened to fastening mechanism 3.

Illustrative damper 6 comprises a leaf spring 23 bent into a ring. Leaf spring 23 has two longitudinal sides 26, which are essentially parallel to handle axis 7 and perpendicular to fastening axis 12. The two longitudinal sides 26 are connected by transverse sides 25, 24 running essentially perpendicular to handle axis 7. One of the transverse sides 24 forms the distal section of leaf spring 23 and can for example be cast into handle rod 2 or be screw-connected to handle rod 2. The other one of the transverse sides 25 forms the proximal section of leaf spring 23 and is fastened to fastening mechanism 3. Proximal transverse side 25 is held along handle axis 7 from one side by tensioning wheel 18 and from the other side by a nut 22. Proximal transverse side 25 has a hole 27 laying on handle axis 7. Pull rod 19 runs through hole 27 and engages with its external thread into the internal thread of nut 22. Pull rod 19 connects nut 22, proximal transverse side 25 and thereby leaf spring 23, tensioning wheel 18, collar 16 and tensioning band 10 into a contiguous unit.

Nut 22 has a head 28 and a neck 29. The head has a diameter larger than hole 27; neck 29 has the same diameter as hole 27. Head 28 abuts proximal transverse side 25; neck 29 protrudes through hole 27. Tensioning wheel 18 is non-rotatably connected to neck 29. For example, neck 29 has a level key surface or a design otherwise asymmetric to handle axis 7. The turning of tensioning wheel 18 is transferred to nut 22 and moves pull rod 19 along handle axis 7.

Longitudinal sides 26 of leaf spring 23 are perpendicular to fastening axis 12. Preferably, longitudinal sides 26 are planar and parallel to each other. Longitudinal sides 26 are each equipped with a slot 32 running along handle axis 7. A splint 33 engages in both slots 32. Splint 33 also sticks into pull rod 19. Splint 33 prevents a twisting of damper 6 in relation to pull rod 19 about handle axis 7. It is hereby ensured that longitudinal sides 26 are oriented perpendicular to fastening axis 12, along which damping is to occur.

Instead of leaf spring 23 with two longitudinal sides 26 bent into a ring, other geometries of leaf springs can be used, as long as these have at least one longitudinal side 26 perpendicular or inclined to fastening axis 12. For example, the leaf spring may be C-shaped, i.e., with a longitudinal side 26 and a distal transverse side 24 and a proximal transverse side 25. Furthermore, the spring leaf may be folded several times to obtain more than two parallel longitudinal sides.

Damper 6 can have a safety retainer 34. Safety retainer 34 is fastened to handle rod 2. Illustrative safety retainer 34 is a hollow cylinder or a hollow, truncated cone. Safety retainer 34 may be open on one side 20 facing fastening mechanism 3. Leaf spring 23 is arranged within safety retainer 34. In a no-load condition, leaf spring 23 is at a distance from interior surfaces 35 of safety retainer 34. A distance of interior surfaces 35 to leaf spring 23 may increase along handle axis 7 of handle rod 2 to fastening mechanism 3. If a deflection of handle rod 2 in relation to fastening mechanism 3 exceeds a critical deflection, leaf spring 23 will abut interior surface 35. Leaf spring 23 is thereby protected against overloading along fastening axis 12.

Tensioning wheel 18 may have a border 36 protruding along handle axis 7, the border overlapping with safety retainer 34 along handle axis 7. Preferably, border 36 engages around safety retainer 34. Border 36 is at a radial distance, in relation to handle axis 7, from safety retainer 34 so as not to influence the damping behavior of damper 6. The radial distance of safety retainer 34 to border 36 is selected in such a manner that in the event of an excessive deflection of handle rod 2 in relation to fastening mechanism 3, safety retainer 34 strikes border 36. Leaf spring 23 is thereby protected from overloading along fastening axis 12.

Safety retainer 34 has two grooves or slots along handle axis 7. The grooves lie opposite slots 32 of leaf spring 23. Splint 33 engages in the grooves. If leaf spring 23 were to break, safety retainer 34 protects handle rod 2 at pull rod 19 and fastening mechanism 3 respectively, and protects the user from a sudden and complete failure of side handle 1.

The invention claimed is:

1. A side handle for a hand-operated power tool, comprising:

a handle rod disposed along a handle axis;

a fastening mechanism, wherein the side handle is releasably fastenable to the hand-operated power tool by the fastening mechanism and wherein the fastening mechanism includes:

a tensioning band that engages around a fastening axis; and a tensioning mechanism, wherein the tensioning mechanism has a collar that overlaps the tensioning band along the handle axis and is displaceable in relation to the tensioning band along the handle axis, wherein the tensioning mechanism has a pull rod that is anchored to the tensioning band and is displaceable along the handle axis, and wherein the tensioning mechanism has a tensioning wheel that is rotatable about the handle axis and engages in an external thread of the pull rod;

a damper, wherein the damper connects the handle rod to the fastening mechanism and includes a leaf spring with at least one longitudinal side oriented in an inclined manner to the fastening axis and wherein the leaf spring has a slot running along the handle axis; and a splint, wherein the splint is fastened to the pull rod and engages in the slot.

2. The side handle according to claim 1, wherein the leaf spring is oriented perpendicular to the fastening axis.

3. The side handle according to claim 1, wherein the splint is oriented along the fastening axis.

4. The side handle according to claim 1, wherein the damper includes a safety retainer which is fastened to the handle rod, wherein the leaf spring is disposed in the safety retainer, wherein the safety retainer has a groove, and wherein the splint engages in the groove.

5. The side handle according to claim 4, wherein the safety retainer has an inclined interior surface and wherein a distance to the longitudinal side of the leaf spring from the inclined interior surface increases in a direction from the handle rod to the fastening mechanism.

6. The side handle according to claim 4, wherein the tensioning wheel has a border protruding in a direction toward the handle rod, wherein the border overlaps the safety retainer along the handle axis, and wherein the border has a clearance to the safety retainer in a direction radial to the handle axis.

7. The side handle according to claim 1, wherein the leaf spring has two longitudinal sides which are parallel to each other and which are connected to each other by transverse sides running perpendicular to the handle axis.

8. The side handle according to claim 7 further comprising a nut with a head and a neck, wherein one of the transverse sides has a hole on the handle axis and wherein the neck is disposed through the hole and the head abuts the one of the transverse sides.

9. The side handle according to claim 8, wherein an external thread of the pull rod engages in the nut.

* * * * *